US009044073B2

(12) United States Patent
Svenson

(10) Patent No.: US 9,044,073 B2
(45) Date of Patent: Jun. 2, 2015

(54) REVERSIBLE BAG

(76) Inventor: Karen Svenson, Norwich, NY (US)

( * ) Notice: Subject to any disclaimer, the term of this patent is extended or adjusted under 35 U.S.C. 154(b) by 814 days.

(21) Appl. No.: 12/719,637

(22) Filed: Mar. 8, 2010

(65) Prior Publication Data

US 2010/0224294 A1 Sep. 9, 2010

Related U.S. Application Data

(60) Provisional application No. 61/158,139, filed on Mar. 6, 2009.

(51) Int. Cl.

| | |
|---|---|
| ***A45C 3/06*** | (2006.01) |
| ***A45C 3/00*** | (2006.01) |
| ***A45C 3/08*** | (2006.01) |
| ***A45C 13/08*** | (2006.01) |
| ***A45C 13/30*** | (2006.01) |
| *A45C 9/00* | (2006.01) |

(52) U.S. Cl.

CPC ..... *A45C 3/06* (2013.01); *A45C 2009/007* (2013.01); *A45C 3/001* (2013.01); *A45C 3/08* (2013.01); *A45C 13/08* (2013.01); *A45C 13/30* (2013.01)

(58) Field of Classification Search

USPC ..... 150/103, 112, 107; 383/4, 41

See application file for complete search history.

(56) References Cited

U.S. PATENT DOCUMENTS

| | | | | |
|---|---|---|---|---|
| 1,084,228 | A * | 1/1914 | Quisenberry et al. | 383/41 |
| 1,489,011 | A * | 4/1924 | Rutledge | 224/610 |
| 1,553,241 | A * | 9/1925 | Hickey | 224/615 |
| 1,683,678 | A * | 9/1928 | Kitterman et al. | 383/22 |
| 1,810,347 | A * | 6/1931 | Daitch | 383/2 |
| 2,029,905 | A * | 2/1936 | Banner | 150/103 |
| 2,063,850 | A * | 12/1936 | Nemeth et al. | 150/103 |
| 2,086,326 | A * | 7/1937 | Goldberg | 2/66 |
| 2,487,145 | A * | 11/1949 | Kuhlman | 383/13 |
| 2,557,280 | A * | 6/1951 | Hahn | 2/66 |
| 2,580,796 | A * | 1/1952 | Kleiss et al. | 383/6 |
| 2,626,648 | A * | 1/1953 | Anderson | 383/4 |
| 2,771,112 | A * | 11/1956 | Ingram | 150/101 |
| 2,865,418 | A * | 12/1958 | Bourdon | 206/287 |
| 3,108,627 | A | 10/1963 | Tatelman | |
| 3,229,741 | A * | 1/1966 | Ambrose | 383/2 |
| 3,797,043 | A * | 3/1974 | Brument | 2/69.5 |
| 4,301,849 | A | 11/1981 | Litwack et al. | |
| 4,535,878 | A * | 8/1985 | Grahl | 190/1 |
| 4,873,736 | A * | 10/1989 | Sapp et al. | 5/636 |
| 5,653,337 | A * | 8/1997 | Cirigliano | 206/373 |
| 5,724,672 | A | 3/1998 | Chen | |
| 5,890,639 | A | 4/1999 | Hancock et al. | |
| 5,941,437 | A * | 8/1999 | Okumura | 224/585 |
| 6,687,931 | B1 * | 2/2004 | Benavides | 5/490 |
| 7,028,730 | B2 | 4/2006 | Pace et al. | |
| 7,607,461 | B2 | 10/2009 | Pace et al. | |
| 7,628,187 | B2 | 12/2009 | Mittelstaedt | |
| 7,828,027 | B2 * | 11/2010 | Mangano et al. | 150/103 |
| 2005/0241093 | A1 * | 11/2005 | McKenzie | 15/209.1 |
| 2006/0157175 | A1 | 7/2006 | Pace et al. | |

(Continued)

*Primary Examiner* — Tri Mai

(74) *Attorney, Agent, or Firm* — George R. McGuire; Frederick J. M. Price; Bond Schoeneck & King, PLLC

(57) ABSTRACT

A reversible carrying bag that includes fabric panels positioned in overlying relation to one another and stitched along opposing side edges. Flaps formed along the opposing top and bottom edges form passages through which carrying straps may extend. The carrying bag may also include fasteners affixed to the edges of the panels for attaching to a handle.

1 Claim, 6 Drawing Sheets

(56) References Cited

U.S. PATENT DOCUMENTS

2006/0278311 A1 12/2006 Mittelstaedt
2007/0163689 A1 7/2007 Pace et al.
2007/0295773 A1 12/2007 Wegenhoft
2010/0200129 A1 * 8/2010 Polozzolo et al. ..... 150/105

* cited by examiner

REVERSIBLE BAG

CROSS-REFERENCE TO RELATED APPLICATIONS

This application claims priority to U.S. Provisional Patent Application No. 61/158,139 filed Mar. 6, 2009, which is incorporated by reference herein.

BACKGROUND OF THE INVENTION

1. Field of the Invention

The present invention relates to bags, totes, pocketbooks, and like carrying accessories, and more particularly, to such carrying devices that are reversible such that multiple fashion choices can be made with the single item.

2. Description of the Related Art

Diaper bags, pocket books, totes, and similar carrying bags are typically selected based on a combination of their utility as well as their fashionability. As the utility served by a carrying bag is satisfied regardless of the ornamental appearance of the bag, having multiple bags that look differently but that achieve the same utility is an expense that many cannot afford. Thus, for these people, they either make due without, or purchase multiple bags even if the expense is unjustified.

To increase the fashion options for people who prefer not to incur the expense with purchasing many bags, there are bags that include reversible fabric features, overlays, or other options that provide the ability to change the appearance of the bag. Examples of such reversible or interchangeable cover type bags can be seen in U.S. Patent Application Publication 2006/0157175 to Pace et al (now U.S. Pat. No. 7,607,461); 2006/0278311 to Mittelstaedt (now U.S. Pat. No. 7,628,187); 2007/0163689 to Pace et al.; 2007/0295773 to Wegenhoft; and U.S. Pat. No. 3,108,627 to Tatelman; U.S. Pat. No. 4,301,849 to Litwack et al; U.S. Pat. No. 5,653,337 to Cirigliano; U.S. Pat. No. 5,724,672 to Chen; U.S. Pat. No. 5,890,639 to Hancock et al.; and U.S. Pat. No. 7,028,730 to Pace et al.

BRIEF SUMMARY OF THE INVENTION

It is therefore a principal object and advantage of the present invention to provide a carrying bag that includes differently patterned patterns that may be reversed so that different designs may be exteriorly exposed.

It is another object and advantage of the present invention to provide a bag that is ideal for the many different demands of traveling.

Other objects and advantages of the present invention will in part be obvious, and in part appear hereinafter.

In accordance with the foregoing objects and advantages, the present invention provides a reversible hand bag. In one aspect of the present invention, the bag comprises a two-way reversible bag comprising first and second differently-designed fabric panels that have been stitched in overlying relation to one another. The two conjoined panels are then folded in half and stitched along the majority of their side edges, leaving an open top with a short flap of unstitched fabric on each side. The short flaps of fabric on the opposing edges of the conjoined panels are then folded over and stitched to form a passage that extends along the open top of the bag and through which each a strap may pass. A D-ring, O-Ring, grommet or other fastening member may be joined exteriorly of the bag and opposing ends of the two straps that pass through the bag's opposing edges, and then a third strap may attached to at its opposing ends to the D-ring, O-ring, or grommet and used as the shoulder strap for the bag. To reverse the bag, the third strap may be detached from the bag, the bag turned inside-out, and the third strap reattached. The second fabric is now on the exterior of the bag, giving the bag a different appearance from when the first fabric was on the exterior.

In a second aspect of the invention, the bag includes three different designs that may be exteriorly exposed. A first panel is of a first design, while the second and third panels are collectively stitched along their side edges in over-lying relation to the first panel. By using second and third panels, two open pouches are formed, one between the first and second panels, and one between the first and third panels, with an open area in between the two pouches. The side edges in this second aspect of the invention remain unstitched, but may include any fastening means known to those skilled in the art, including snaps, buttons, magnets, zippers, or VELCRO® fasteners, to close the side edges. In a first position, the first panel is exteriorly exposed, and when in the second position, which requires folding the panels in the opposite direction, the second and third panels are exposed. Straps are incorporated in the same manner as with the first aspect of the invention. Moreover, the reversible carrying bag of an embodiment of the present invention can include one or more of the following a first fabric panel including first, second, third and fourth edges, wherein the first fabric panel can include the exterior face of the reversible carrying bag when the bag is in a first configuration; a second fabric panel including first, second, third and fourth edges, wherein the second fabric panel includes the exterior face of the bag when said bag is in a second configuration; a third fabric panel including first, second, third and fourth edges, wherein the third fabric panel is in stitched relation to the first and second fabric panels; where the third fabric panel comprises the exterior face of the bag when the bag is in the second configuration; where a first portion of the first edge of the first fabric panel is in stitched relation to the first edge of the second fabric panel and a second portion of the first edge of the first fabric panel is in stitched relation to the first edge of the third panel, and a first portion of the second edge of the first fabric panel is in stitched relation to the said second edge of said second fabric panel and a second portion of the second edge of the first fabric panel is in stitched relation to the second edge of the third fabric panel, thereby defining a sleeve with a first open end at the third edge of the first and second panels and a second open end at the fourth edge of the first panel and the third edge of the third panel; a first pocket defined by the exterior surface of the first fabric panel and the interior surface of a third fabric panel affixed to the first fabric panel, wherein the first pocket is located on the exterior of the bag when the bag is in the first configuration and is located on the interior of the bag when the bag is in the second configuration; and a second pocket defined by the exterior surface of the first fabric panel and the interior surface of a fourth fabric panel affixed to the first fabric panel, wherein the second pocket is located on the exterior of the bag when the bag is in said first configuration and is located on the interior of the bag when the bag is in the second configuration.

In a third aspect of the invention, the bag includes four different designs that may be exteriorly exposed. First and second panels are joined along a common edge, and third and fourth panels are likewise joined along a common edge and then stitched along their side edges in overlying relation to the first and second panels. Folding the conjoined panels in half forms two separate pouches, one between the first and third panels, and one between the second and fourth panels, as well as an open area interiorly between the third and fourth panels (when the first and second panels are exteriorly exposed). Straps are attached in the same manner as with the first aspect of the invention.

In a fourth aspect of the invention, the reversible carrying bag includes a first fabric panel that has four edges and forms the exterior face of the bag when the bag is in a first configuration. The bag also includes a second fabric panel that has four edges and forms the exterior face of the bag when the bag is in a second configuration. Each of the four edges of the first panel are stitched to the corresponding four edges of the second fabric panel. The bag includes a channel at opposite ends of the stitched panels. In one embodiment, the channel is formed by excess lengths of the first or second panels used to form flaps that can be folded over and stitched to form two channels, each with two open ends. The bag includes two straps, each running through one of the channels, and a third strap that connects to the two other straps. In one embodiment, the bag includes fastening means to connect and close the sides of the bag when the bag is folded in half and thus in the first or second configuration.

In a fifth aspect of the invention, the reversible carrying bag includes two pockets. The pockets are created by stitching a fabric panel on either side of one of the above fabric panels. The pocket is then either on the outside or inside of the bag, depending on the configuration.

In a sixth aspect of the invention, the reversible bag includes fasteners instead of or in addition to channels. The bag includes first, second, third and fourth fasteners connected to the stitched panels. The first and second fasteners are located along two opposite edges of the panels, and the third and fourth fasteners are located along the same edges, but at the distal end of the panel. When the bag is folded in half, the first and third fasteners are brought together, and the second and fourth fasteners are brought together. A strap is then connected to all four fasteners.

In a seventh aspect of the invention, the reversible carrying bag includes a first double-sided stitched panel made up of a first fabric panel stitched to a second fabric panel. The bag includes a third fabric panel stitched to a fourth fabric panel. The first and second double-sided stitched panels therefore each form a single panel each with a different panel on each side. The two double-sided stitched panels are then themselves stitched together on two sides to form a sleeve that can be pulled inside-out, thereby creating a bag with four faces.

In an eight aspect of the invention, the reversible carrying bag includes an insert made of any suitable material such as fabric or plastic. The insert is designed to be of a suitable size to be quickly and easily placed into or removed from the bag when the user reverses the bag from a first configuration to a second configuration.

BRIEF DESCRIPTION OF THE SEVERAL VIEWS OF THE DRAWING(S)

The present invention will be more fully understood and appreciated by reading the following Detailed Description in conjunction with the accompanying drawings, in which.

Figure 5A:
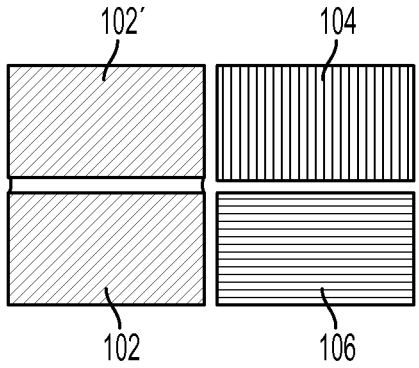
Figure 5B:
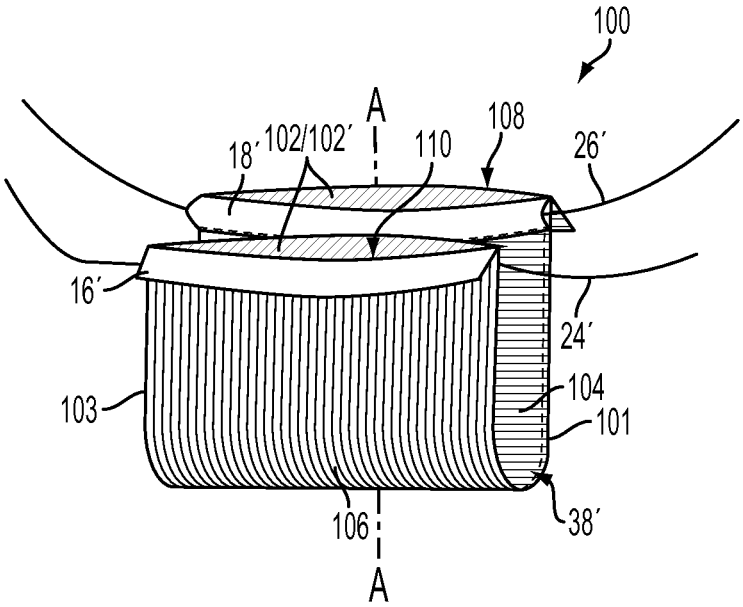
Figure 5C:
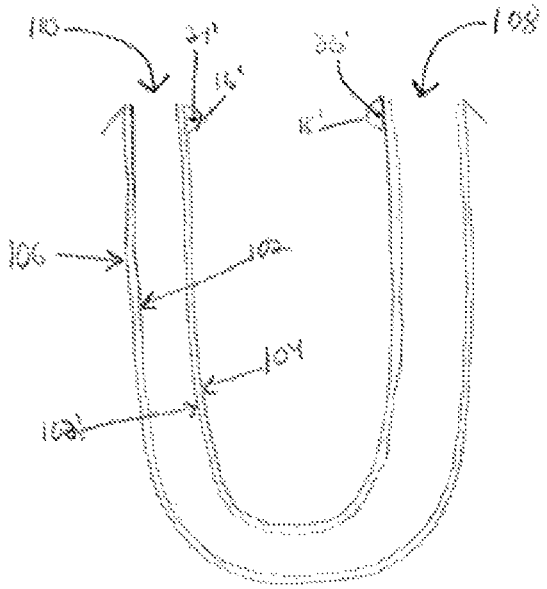

FIG. 5*a* is a perspective view illustrating the panels of a three-way reversible bag in accordance with the present invention, FIG. 5*b* is a perspective view of a three-way reversible bag in accordance with the present invention, and FIG. 5*c* is a cross sectional view through line A-A of FIG. 5*b;*

Figure 6:
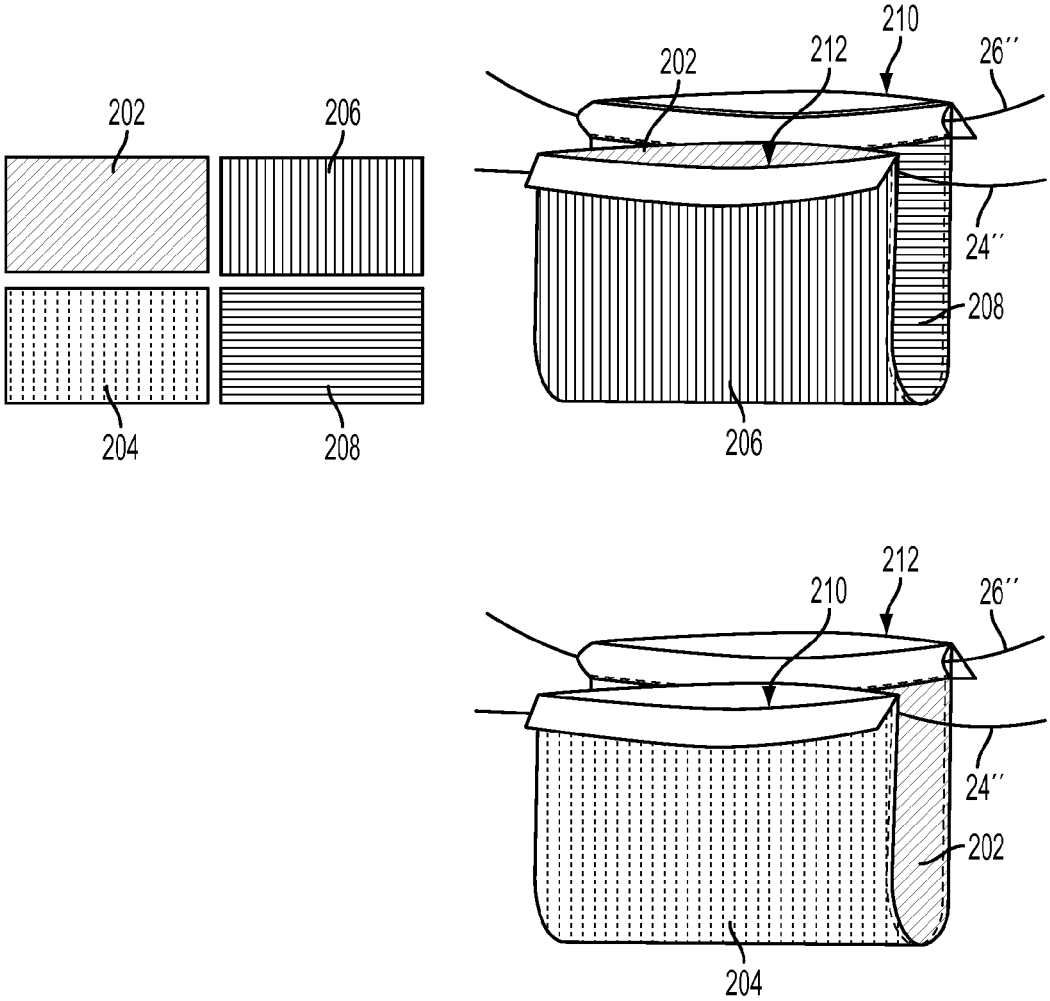
Figure 7A:
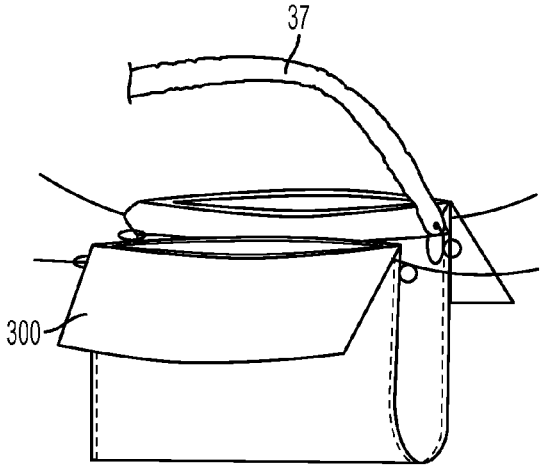
Figure 7B:
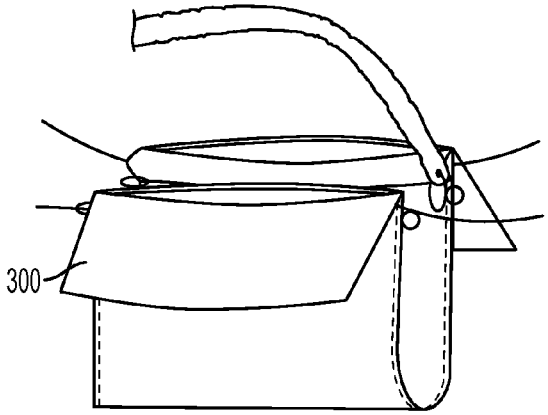
Figure 8:
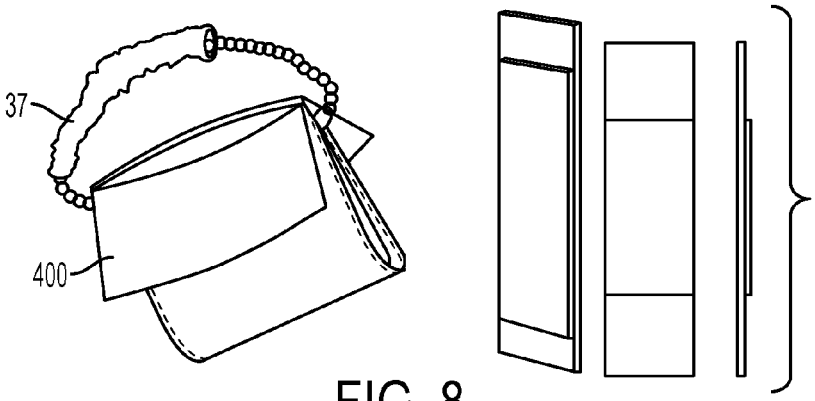
Figure 9:
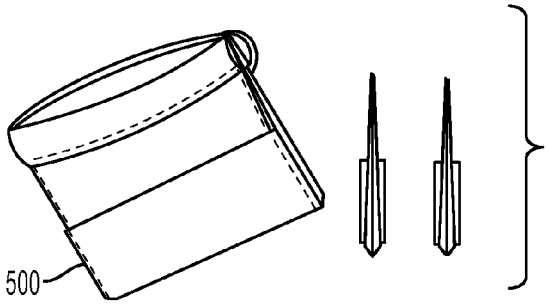

FIG. 6 is a perspective view of a four-way reversible bag in accordance with the present invention;

FIGS. 7*a* and 7*b* are perspective views of alternate versions of the 3-way and 4-way reversible bags;

FIG. 8 is a perspective view of an alternate version of the 2-way reversible bag; and FIG. 9 is a perspective view of another alternate version of the 2-way reversible bag.

DETAILED DESCRIPTION OF THE INVENTION

Figure 1:
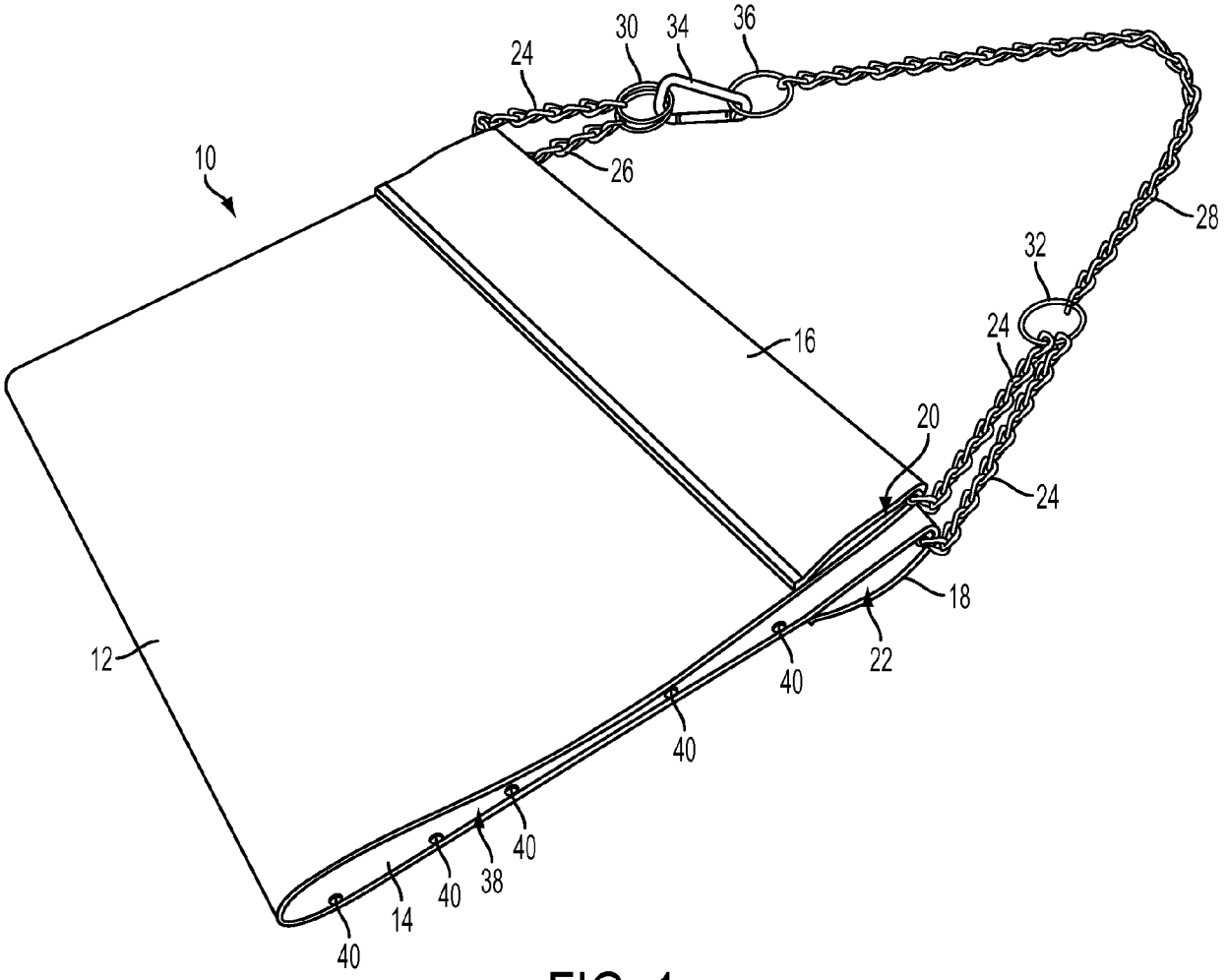
FIG. 1 is a perspective view of a two-way reversible handbag in accordance with the present invention.
Figure 2:
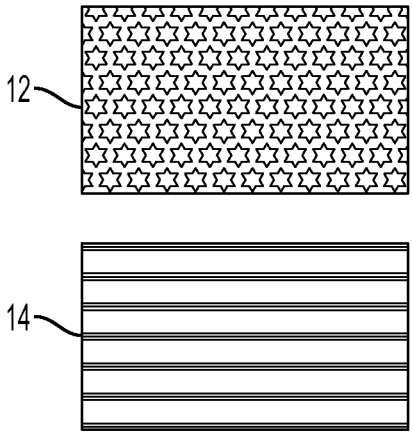
FIG. 2 is a plan view of the first and second panels used in the bag of FIG. 1.
Figure 3:
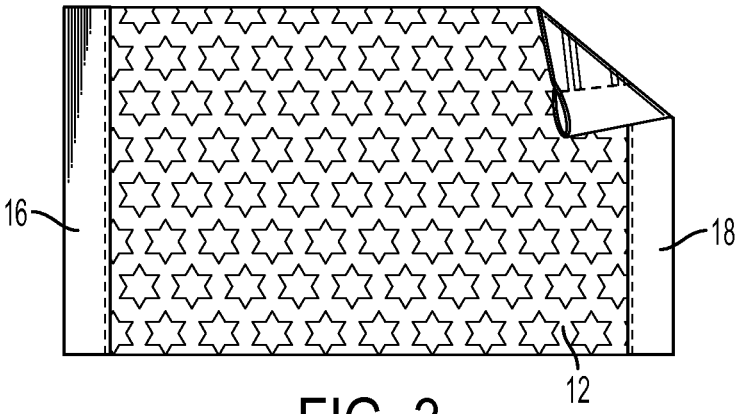
FIG. 3 is a plan view of the first panel with opposing edges stitched to form a strap passage.
Figure 4:
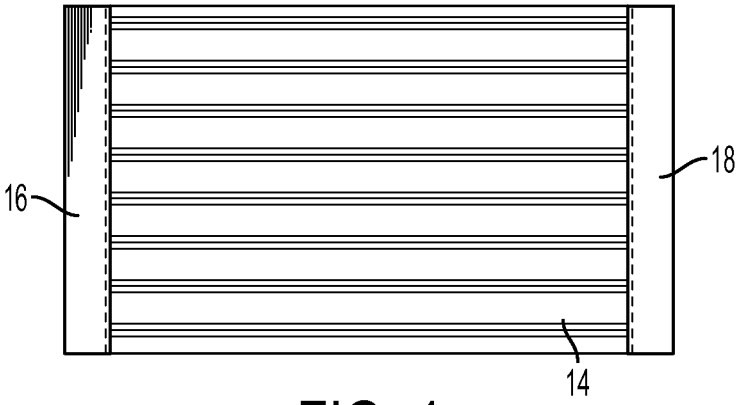
FIG. 4 is a plan view of the second panel with opposing edges stitched to form a strap passage.

Referring now to the drawings, wherein like reference numerals refer to like parts throughout, there is seen in FIG. 1 a carrying bag designated generally by reference numeral 10 generally comprising a first fabric panel 12 and a second fabric panel 14. Fabric panels 12 and 14 are stitched in overlying relation to one another, and the conjoined panels 12, 14 include flaps 16, 18 on opposing sides that are folded back and stitched to form respective passages 20, 22, respectively. First and second straps 24, 26 extend through passages 20, 22, respectively, and are joined with a unitary third strap 28 via O-rings 30, 32 and a carabineer 34/O-ring 36 that permits selective detachment of the third strap form the first and second straps. As seen in FIG. 7, a fabric cover 37 may be placed over the strap so that it matches or coordinates with the fabric of the bag 10.

In another embodiment, flaps 16 and 18 are not stitched onto the bag, but are used to close the top opening of the bag, or are used as another means to change the look of the bag. For example, flap 16 could be folded inside the bag such that it is not in view, or can change the look of the bag by being folded down over the outside of the bag, as shown in FIG. 1. The flaps can be an extension of the fabric panels, or can be comprised of any material known to those skilled in the art of decorative materials.

Bag 10 may be used with panel 12 exteriorly exposed by folding the conjoined panels 12, 14 about their middle, attaching the third strap 28 and storing items in the open area 38 that is subsequently formed between the folded panels. The side edges of conjoined panels 12, 14 may be stitched, or are alternatively fastened using snaps 40 or any other fastening means known to those skilled in the art, including snaps, buttons, magnets, zippers, or VELCRO®, or may remain unsecured such that the bag forms a roll.

Bag 10 may be reversed by detaching third strap 28, folding the panels 12, 14 in the opposite direction, thereby exteriorly exposing panel 14 instead of panel 12, and then reattaching third strap 28.

In another embodiment, the bag can further comprise a removable insert. The insert is comprised of any suitable material, including but not limited to fabric or plastic, and is adapted to hold the user's contents inside the bag. When the user wishes to reverse the bag from one orientation to another, the user can simply pull out the insert, reverse the bag, and then put the insert back into the new configuration. Alternatively, the user can move the insert from one bag to another. The insert allows the user to reverse a bag without taking individual items in and out of the bag, thereby saving a significant amount of time and effort.

With regard to FIG. 5*b*, a three-way bag 100 is shown. Bag 100 is similar to bag 10, except it includes a first panel 102, a second panel 102' with the same design as the first panel 102, and then third and fourth panels 104, 106 that are overlaid on panel 102' and 102, respectively. Flaps 16,' and 18' form passages for the straps 24' and 26', and the top edges between panels 102', 104, and 102, 106 are left open, thereby forming first and second enclosed pockets 108, 110, respectively, as well as the roll 38' that is formed between the interiorly facing panels.

With regard to FIG. 6, a four-way bag 200 is shown. Bag 200 is similar to bag 100 except it includes first and second panels 202, 204 that re joined along a common edge, and third and fourth panels 206, 208 that are also joined along a common edge. First and second panels 202, 204, are then positioned in overlying relation to panels 206, 208, respectively, and stitched along their opposing edges, leaving the other opposing edges open to form pockets 210, 212 (which are analogous to pockets 108, 110). Handles 24" and 26" remain the same as with the other embodiments.

With regard to FIGS. 7*a* and 7*b*, added flaps 300 that are closed along their bottom end and open along the top are provide for the 3-way and 4-way reversible bag of FIGS. 5 and 6 to provide pockets on either the exterior or interior of the bag depending on which position the bag is set. With regard to FIG. 8, the can be modified with larger fold-over flaps 400, while in FIG. 8 pockets 500 can be formed on opposing panels such that exterior or interior pockets are incorporated into the bag, depending on which of the orientations that bag is set. Additionally, as shown in FIGS. 7*a* and 7*b*, the handle can be attached to the bag via four fasteners attached to the edges of the panels.

Although the present invention has been described in connection with a preferred embodiment, it should be understood that modifications, alterations, and additions can be made to the invention without departing from the scope of the invention as defined by the claims.

What is claimed is:

1. A reversible carrying bag (10) comprising:

a first double sided fabric panel (102'/104) comprising a first fabric panel (102') in stitched relation to a second fabric panel (104), wherein said first fabric panel comprises a first design and the exterior face of the bag when said bag is in a first configuration and the second fabric panel comprises a second design and the exterior face of the bag when said bag is in a second configuration;

a second double-sided fabric panel (102/106) comprising a third fabric panel (102 in stitched relation to a fourth fabric panel (106), wherein said third panel comprises a third design that is the same as the first design, and further wherein the fourth fabric panel comprises a third design and the exterior face of said bag when said bag is in a third configuration;

wherein a first edge of said first double-sided stitched fabric panel is in stitched relation with a first edge of said second double-sided stitched fabric panel at a first stitched portion (101), and wherein a second edge of said first double-sided stitched fabric panel is in stitched relation with a second edge of said second double-sided stitched fabric panel at a second stitched portion (103), said first and second double-sided stitched fabric panels thereby defining a sleeve with a first open end (108) at a third edge of said first and second double-sided stitched fabric panels and a second open end (110) at a fourth edge of said first and second double-sided stitched fabric panels;

wherein said first open end further comprises a first channel (16') extending in a longitudinal direction along an edge thereof;

wherein said second open end further comprises a second channel (18') extending in a longitudinal direction along an edge thereof;

a first strap (24') comprising a first end and a second end extending through said first channel;

a second strap (26') comprising a first end and a second end extending through said second channel;

wherein each of said first end of said first strap and said first end of said second strap connect to a first end of a third strap (28), and each of said second end of said first strap and said second end of said second strap connect to a second end of a third strap to form a handle; and further wherein said bag is converted from said first configuration to said second configuration by turning the bag inside out, and wherein said bag is converted from said second configuration to said third configuration by folding the bag in half to expose the fourth fabric panel to the outside of said bag.

* * * * *